United States Patent [19]

Ward et al.

[11] 4,117,895

[45] Oct. 3, 1978

[54] APPARATUS AND METHOD FOR ENLARGING UNDERGROUND ARCUATE BORE HOLES

[75] Inventors: Howard Ward, Newport Beach; John Tschirky, Long Beach, both of Calif.

[73] Assignee: Smith International, Inc., Newport Beach, Calif.

[21] Appl. No.: 782,847

[22] Filed: Mar. 30, 1977

[51] Int. Cl.[2] ..... E21B 3/12

[52] U.S. Cl. ..... 175/53; 175/62; 175/107; 405/184

[58] Field of Search ..... 175/53, 62; 61/72.7

[56] References Cited

U.S. PATENT DOCUMENTS

| | | | |
|---|---|---|---|
| 2,746,719 | 5/1956 | Seligman | 175/53 |
| 2,837,324 | 6/1958 | Aschacker | 175/53 |
| 3,508,620 | 4/1970 | Pennington | 175/53 |
| 3,894,402 | 7/1975 | Cherrington | 175/53 |
| 3,905,431 | 9/1975 | Hasewand | 175/53 |

FOREIGN PATENT DOCUMENTS

| | | | |
|---|---|---|---|
| 422,847 | 4/1974 | U.S.S.R. | 175/53 |

*Primary Examiner*—Ernest R. Purser

*Attorney, Agent, or Firm*—Subkow and Kriegel

[57] ABSTRACT

A hole-opener and a hole-opener apparatus is provided for enlarging a pilot hole of the inverted arcuate type which bypasses an obstacle, the pilot hole having an entrance and terminal end, both ends usually being accessible to surface drilling equipment.

37 Claims, 5 Drawing Figures

APPARATUS AND METHOD FOR ENLARGING UNDERGROUND ARCUATE BORE HOLES

BACKGROUND OF THE INVENTION

This invention relates to an apparatus and method for enlarging a pilot hole such as the inverted arcuate type. More specifically, this invention relates to an apparatus and method for enlarging a pilot hole by means of a hole opener apparatus which may be guided through the pilot hole by a pull tubing or cable to which the hole opener is attached. In one embodiment of the invention, the lead end of the hole opener is rotatably mounted relative to the pull tubing or cable as the hole opener is guide through the pilot hole during enlargement thereof.

Drilling techniques for producing bore holes of the type to which both ends of the bore hole are freely accessible to drilling equipment, to installation of casing, and other procedures usually employed in this art are well known. Reference may be had to the following patents and publications which illustrate the state of the prior art: Zublin, "Horizontal Drilling", Oil Weekly Oct. 1, 1945, p. 35 etc. U.S. Pat. Nos. 3,720,272, 3,667,556, 2,646,253, 2,646,254, 2,656,294, U.S.B.M. Contract Report 1 to 111355 "Dyna Drill" Handbook issued by the Dyna Drill Division of Smith International Corp., 2nd Edition, World of SII, Sept. 1972, Pipe Line and Gas Journal" under "A River Crossing Proves Directional Boring Device", Jan. 4, 1973, and "Directional Drilling Adopted For Pipe Line River Crossing." Pipe Line Industries, Sept. 1974. U.S. Pat. Nos. 3,878,903 and 3,894,402.

STATEMENT OF THE INVENTION

According to this invention, a hole opener assembly is provided which is adapted to be used to enlarge a pilot hole and to follow the course of a pilot hole while it is being enlarged. This is accomplished by pulling the hole opener by a cable or pipe through the pilot hole to the terminal end of the pilot hole with or without additional thrust. This procedure permits the hole opener to be guided accurately along the pilot hole while it is being enlarged. The hole opener may be rotated by an in-hole motor or from the surface. It may be adanced by means of tubing which is positioned in the pilot hole or by a cable which is inserted in the pilot hole. The pilot hole tubing acts as a guide tubing to hold the enlarged hole substantially concentric with the pilot hole. When employing a tube, positioned in the pilot hole and connected to the hole opener, friction against the hole wall is minimized as the opener is pulled or pushed through the pilot hole since the opener and the tubing attached thereto is adapted to rotate relative to and independently of the guide tubing. The guide tubing may, but need not be rotated. If rotated, it may be rotated at a different r.p.m. than the hole opener. This may be sufficient merely to minimize the friction. It need not be rotated at all.

In general, when employing the hole opener assembly and the apparatus and process of this invention, an underground bore hole or pilot hole usually of the inverted arcuate type is first bored from one location here referred to as the entrance end in an arcuate path to another location at the surface termed the exit end. In one embodiment, when drilling of the bore hole is complete, the drill bit is removed from the drill pipe at the terminal end. The drill pipe remains in the hole and acts as the guide tubing. A hole opener or reamer is then attached through a swivel or similar device to the guide pipe at either the entrance or the terminal end. An in-hole motor drill string may be used. Alternatively, the hole opener may be rotated from the surface. The hole opener is advanced by thrusting at the entrance and/or by pulling the drill string in the pilot hole. The hole is then enlarged until the desired size diameter has been obtained. This process may be then followed by emplacement with a casing, installation of an electrical cable, etc. In a preferred embodiment the hole opener is pulled by the guide tubing. This procedure ensures that the guide tubing is in tension and buckling and hole deviation is substantially reduced. An alternative to using the guide tubing, I may, prior to the installation of the hole opener, attach a cable to the guide tubing at either the entrance or exit end and pull the cable through the hole by withdrawing the guide tube. The cable is then attached to the hole opener by a swivel as previously described.

The procedure for production of the pilot hole is well known. We prefer to employ an in-hole motor for this preliminary step.

Essentially the process consists of advancing a hydraulic motor operated drill by a string of drill pipe in an arcuate path from an entrance at the surface to a target or terminal end at a remote position at the surface. The direction and the rate of advance is controlled to produce an inverted arcuate pilot hole. The drill penetrates the surface of the earth at the target area.

This invention relates to process and apparatus for enlarging this bore hole, here referred to as the pilot hole by hole openers to provide an enlarged bore having substantially the same vertical angular and compass direction (azimuthal direction) as the pilot hole.

Figure 1:
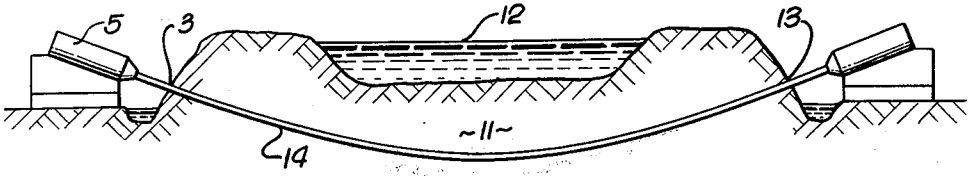
FIG. 1 is a schematic of a drill bore such as is to be enlarged by the method and apparatus of our invention.
Figure 2:
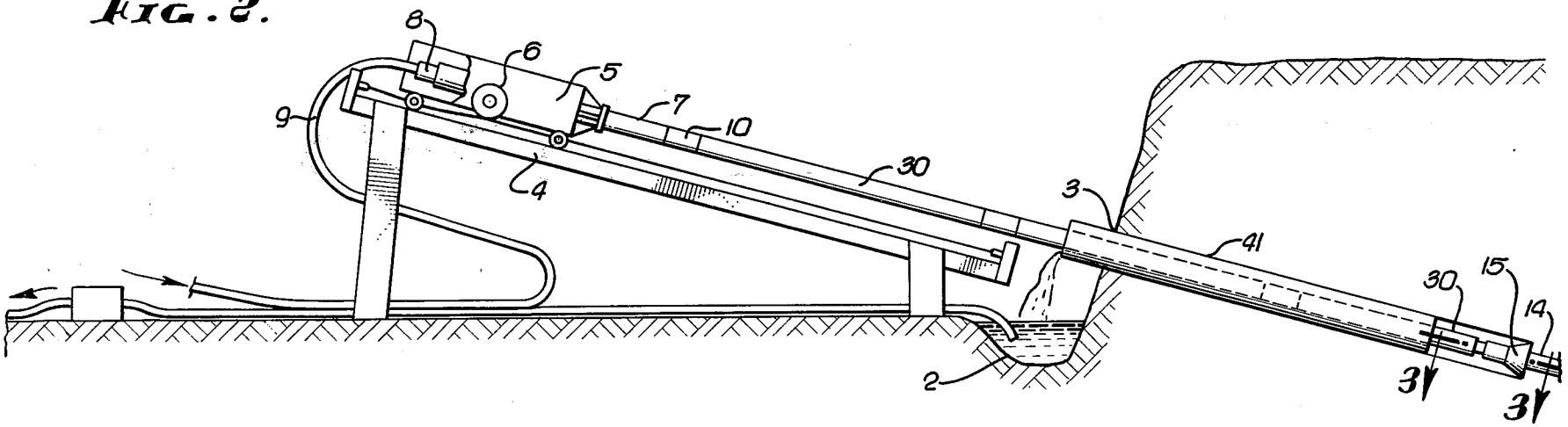
FIG. 2 is a schematic of the entrance end of a bore being enlarged by the method and apparatus of our invention.

The use of a thrust and rotating device such as is shown schematically at FIGS. 1 and 2, for drilling a deviated hole from one surface location to another surface location and underneath an obstruction has been employed in the prior art as stated above. The details of the construction of such a device is not a part of our invention.

In general, it includes a device which may be advanced or withdrawn on an inclined ramp. It holds and may rotate a pipe. At the end of the pipe a drill is connected. Provision is made for circulation of drilling fluid down the pipe through nozzles in the drill bit and the fluid and cuttings returned to the surface through the annulus between the drill pipe and the bore hole wall.

We employ such a device as shown in FIGS. 1 and 2. As is usual, we provide a trench and a mud sump 2 at the entrance end 3 of the bore hole. An inclined ramp 4 is provided. The drill motor 5 is mounted to be advanced or retracted on the ramp 4 by some mechanism such as a cog wheel 6 or other suitable devices.

Means is provided to rotate a hollow shaft 7 similar to a kelly used in rotary tables in bore hole drilling. The shaft at one end is connected to a hollow swivel 8 and to a hose 9 through which drilling fluid may be passed, while rotating the shaft 7.

Assume that a deviated bore hole has been drilled by conventional techniques for example, such as is shown schematically at 11 under an obstruction 12, such as a river, from the entrance end 3 (FIGS. 1 and 2) to the terminal end 13 where the drill bit exits. The purpose of our invention is to enlarge the diameter of the bore hole without substantially altering its course through the ground.

The conventional bore hole such as is shown in FIG. 1 is formed, employing, for example, the power pack 5–9 connected to suitable drill pipe 14. The drill pipe is standard and is made up of drill pipe sections which are added to the drill pipe by means of suitable connectors such as 10. The drill pipe with a bit at its forward end is entered in an inclined but straight direction until a desired depth is reached such that at the radius of curvature permitted by the drill pipe and its associated drilling equipment, the bit will reach the target exit end 13. This procedure is well known in this art.

Figure 3:
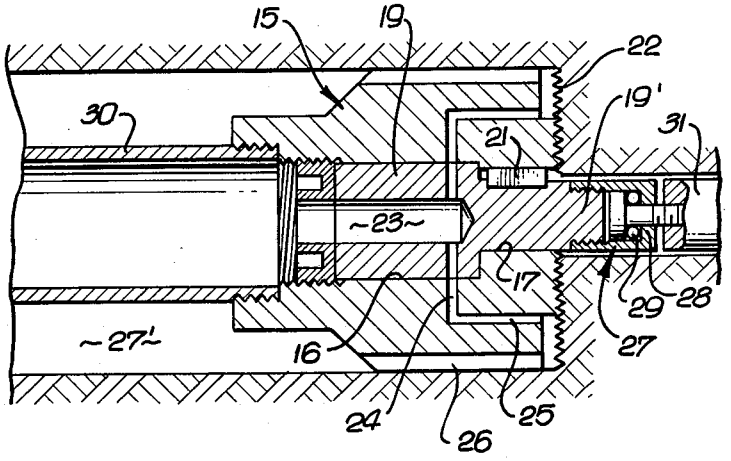
FIG. 3 is a section taken on 3—3 of FIG. 2.
Figure 4:
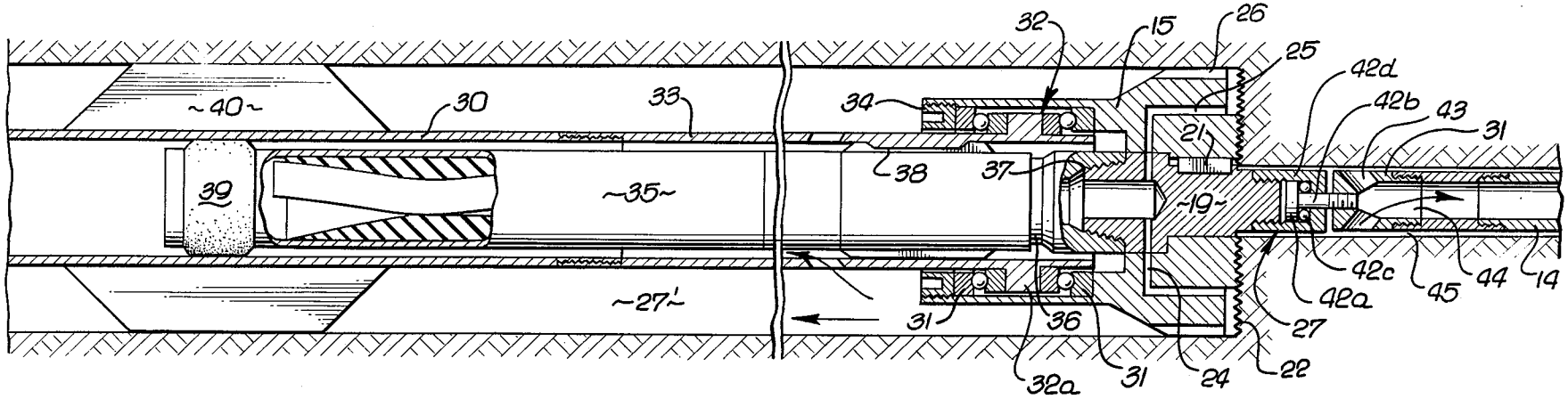
FIG. 4 is a detail of a preferred embodiment of our invention.
Figure 5:
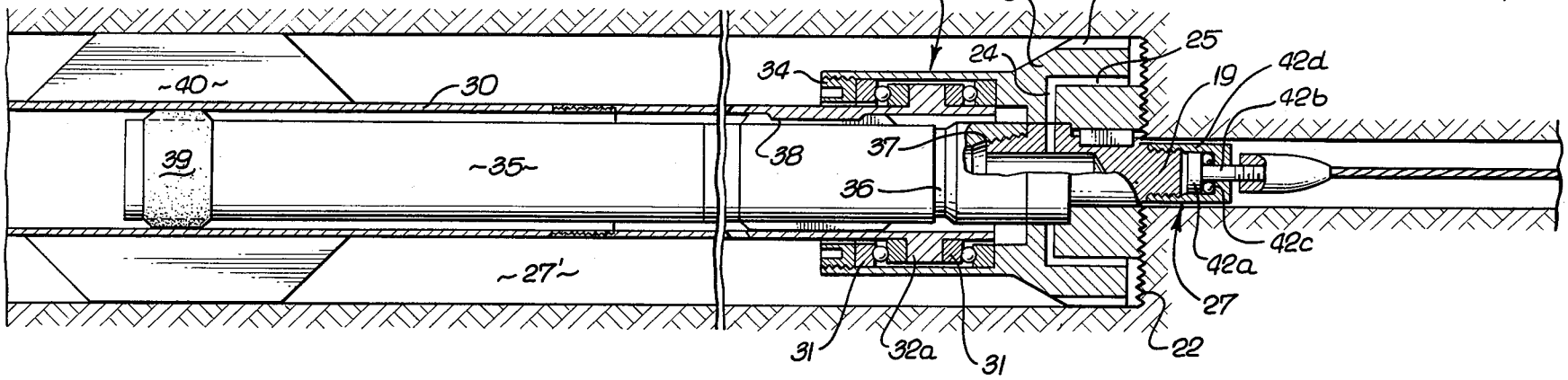
FIG. 5 is an alternative embodiment of a detail of our invention.

With such a bore hole, we disconnect the drill pipe from the drill motor 5, with the motor pack at its downward end on the ramp. The assemblies shown in FIGS. 3–5 are connected at 10 in place of the drill pipe 14, using suitable pipe connectors at 10 as will be understood by those skilled in this art. The sections are advanced into the earth by advancing the motor 5 down the ramp and by rotating the drill pipe. Mud is circulated through hose 9, via swivel 8 down the drill pipe as will be understood by those skilled in this art and out the fluid passageways provided in the hole opener to be returned to the surface.

Referring to FIG. 3, where the power to rotate the hole opener 15 comes entirely from the surface, the hole opener 15 is threaded on the pipe 30 which extends in the bore hole from the exit end to the entrance end. The drill pipe 30 may be of diameter larger than drill pipe 14 and be provided with suitable stabilizers, as is more fully described below. The hole opener has a central bore 16 and counter bore 17 providing an internal shoulder. The swivel body member 19, is inserted into the bore 16 and 17 before assembly on the pipe 30 and held securely at against axial displacement and by key 21 to rotate with the hole opener 15. The body member carries a swivel assembly 27.

The hole opener 15 is provided with the required drilling surface 22 which may be hard faced teeth, diamonds or other hard material as is conventional for hole openers.

In order to provide circulation of drilling fluid passageways 23 and 24 are provided to register with nozzles 25 at the drill bit end to provide for circulation of drilling mud through the pipe 9, hollow shaft 7 and through the drill pipe 30, central bore 23 ports, 24 and nozzles 25 to return through grooves 26 and annulus 27' to the surface as will be described below.

The swivel body 19 has at its end herein referred to as the pilot nose 19', which protrudes from the hole opener. It carries at its forward end a swivel assembly 27 screwed on 19' and having ball races 28 and balls 29 and the swivel may be connected to the tabular member 31 and drill pipe 14 as shown in FIG. 4 or to a cable as in FIG. 5 as will be more fully described below.

The hole opener 15 may be connected at both ends to drill pipe 14, and to the hollow shaft 7. The hole opener and the drill pipe 14 in the bore hole may thus be rotated independently of each other, or the drill pipe 14 in the hole may remain non-rotated while the hole opener is rotated.

At the exit end 13 of the bore hole the drill pipe is connected by a coupling 10 to the hollow shaft of another motor mounted on a ramp, the same as shown in FIGS. 1 and 2.

The power pack rotates pipe 30 at the entrance which rotates the hole opener 15, while drilling fluid such as drilling mud, is pumped through 9 (FIG. 2), and through 7, pipe 30 and nozzles 25 to return through the channel 26 and annulus 27' to be discharged into the mud sump 2 to be treated to remove cuttings from the mud to recirculation through 9.

The mud may also pass through the swivel 27 at the exit end 13 and pipe 14 to be returned to the surface for like treatment and recirculation, as will be described more fully below.

The hole opener is advanced either by applying power to the motor at the entrance to cause the motor to advance down the ramp and to create a thrust on the pipe 30 and the hole opener, or by causing the motor at the exit end to be retracted up its ramp to pull the hole opener into the hole, by pulling on the hole opener rom the exit end or by both techniques.

The drill pipe 14 may be rotated or not rotated or rotated at different rates of rotation than the drill pipe 30 as will be described below.

The rate of advance depends on the rate of rotation of 15 and the thrust of the hole opener against the end of the bore hole. The control of the angular deviation is made possible by application of standard drilling techniques aided by the technology made available as a result of our invention. The ability to both push and pull on the bore hole opener permits a more accurate control for the pull may act as a trimming force on the thrust on the hole opener.

By introducing a swivel connection between the hole opener and the guide pipe 14, the torque imposed on the pipe 14 may be minimized and the resistance to rotation of the hole opener reduced as compared to a solid connection between the pipe 14 and the hole opener.

The rotation of the pipe 14 may be only sufficient to prevent seizure of the pipe by the hole and facilitate ease of longitudinal movement at the bore hole opener.

A substantial part of the power required to open the hole, especially when a long string of pipe must be rotated in a deviated bore hole as described above, is in the friction of the pipe against the bore hole.

For these and other reasons we prefer to employ an in-hole motor to rotate the hole opener. Such in-hole motors are well known and include electrical motors, and hydraulic motors driven by the drilling fluid. Such hydraulic motors include turbine motors and positive displacement advancing cavity motors such as shown in U.S. Pat. No. 3,857,655. We prefer to use the last named type.

FIGS. 4 and 5 show such an assembly.

In FIG. 4 the hole opener 15 of design similar to that described for FIG. 3, with like parts bearing the same number, is mounted on the drill pipe 30 via the swivel thrust bearing 32. The ball races 31' coact with flange **32*a* mounted on the tabular fitting 33 connected to tubing 30. The hole opener is secured by the internal ring nut 34. The swivel 19 referred to above is constructed as shown in FIG. 4**.

The hydraulic motor 35 such as that shown in the above U.S. Pat. No. 3,857,655 carrying a conventional stator and rotor carries the conventional hollow drive shaft 36 which is screw connected at 37 to the swivel 19 which is keyed at 21 to the hole opener 15.

The housing of the in-hole motor is connected by a spline 38 to the fitting 33. The packer 39 is provided. The passage of drilling fluid from 30 through the stator and through the hollow shaft 36 and eventually through nozzles 25 will cause a rotation of the shaft 36 and the hole opener. The by-passing of the motor is prevented by the packer 39. The usual counter rotating torque induced on the housing is countered by holding the tubing 30 at the surface to prevent the counter torque robbing the hole opener of hourse power required to drive the bit.

When employing the tubing 14 as a guide tubing and thrust assist, the swivel 27, includes, a head **42*a* shank 42*b* and balls 42*c*. The cup 42*d* screwed onto 19 and the shank 42*b* is screwed onto cup 31 to which pipe 14 is coupled. Ports 43** are provided.

While the tube 30 may be held at the surface against rotation it is usual to rotate 30 in the same angular direction as the rotation of the hole opener but at much smaller r.p.m. to reduce the friction and viscous shear against the liquid in the bore hole as the pipe 30 is advanced down the hole. The usual bent housing and bent subs (not shown) may be employed to aid the free movement of the bore hole opener in its pre-ordained course. Stabilizers 40 also aid in this procedure. Such devices are well known in this art for use in deviated drilling.

The provision of the swivel 27 permits the independent control of the rotation of the bore hole opener and the use of the pipe 14 to assist in the creation of the thrust of the hole opener against the formation.

To start the hole opener, the section of the pipe 30 adjacent the hole opener is employed using an in-hole motor with a straight housing and without a bent sub to drill an enlarged bore hole for a length substantially equal to the straight section drilled at the entrance in preparing the pilot hole.

After the section has been enlarged, the pipe 30 is disconnected from the motor 5 and the surface pipe 41 is inserted. The hole opener is disconnected and a bent sub (see copending application Ser. No. 683,193 filed May 4, 1976) and a motor with a bent housing (see U.S. Pat. No. 3,260,318) of suitable angularity, for example 1 to 3°, is inserted and a stabilizer 40 is employed as is conventional in deviated drilling and the hole opener again advanced as described above guided through the pilot hole by the pilot pipe as described above. Drilling fluid is circulated as previously described down 30 through the nozzles 25 between the drilling end 22 and part of the fluid is returned via the grooves 26 to the surface. Part of the fluid will pass via the annulus 45 through the ports 43 into the pipe 14 to the surface at 13.

Instead of employing the pilot pipe as a means for aiding in the advance of the hole opener by imparting a pull therein, we may employ a cable as illustrated in FIG. 5. We provide a cable connector through which the cable is threaded. The connector is screwed on to shank **42*b***.

To employ the cable, when the pilot bore hole is completed, the swivel 27 (see FIG. 5) is attached to the pipe 14 while still in the hole, at its terminal end at 13. The pipe 14 is withdrawn towards the entrance, thus drawing the cable through the hole.

For use with the cable, the swivel 27 is attached to 19 and the cable at its terminal end is attached to a winch or the power pack at the exit end 13. The swivel prevents the cable from winding up and permits a smooth operation.

In both of the forms shown in FIGS. 4 and 5 the pipe 30 may or may not be rotated. The drilling fluid is circulated as described in connection with FIG. 4 to return through the annulus exteriorly of pipe 30, to the entrance end, part returning through the pilot hole to the terminal exit end.

In all of our operations, pipe sections are added to the pipe 14 and 30 as advanced and after the hole opener cuts the hole at the exit end, the pipe 30 may be left implaced in the hole and may be cemented in the hole by conventional techniques used for cementing casing in the bore hole.

We claim:

1. An apparatus for enlarging a bore hole extending from one surface location to a terminal exit end at a remote location: said apparatus including a pipe extending from said one surface location into said bore hole, means at the surface to impose a thrust on said pipe, a hole opener assembly attached to said pipe at one side of said hole opener, said bore hole extending from said exit end to said hole opener, a swivel connected to said hole opener at the other side thereof, a member extending longitudinally in said bore hole to said exit end and connected to said swivel, and means positioned at the exit end to apply a pull to said member while said hole opener is rotated, means to circulate drilling fluid through said pipe, and means to rotate said hole opener.

2. The apparatus of claim 1, and means at said entrance end to apply rotation to said pipe and means to transmit rotation from said pipe to said hole opener.

3. The apparatus of claim 1 in which said member is a pipe, extending through the bore hole to the exit end.

4. The apparatus of claim 3, and at said entrance end to apply rotation to said first named pipe and means to transmit rotation from said first named pipe to said hole opener.

5. The apparatus of claim 3, and means to circulate drilling fluid through said first named pipe connected to said hole opener, means to circulate fluid through the hole opener to be returned exteriorly of said first named pipe to the entrance end and means to circulate fluid from said hole opener through the pipe in said bore hole connected to said swivel.

6. The apparatus of claim 5, and means at said entrance end to apply rotation to said first named pipe and means to transmit rotation from said first named pipe to said hole opener.

7. The apparatus according to claim 1, said member being a cable connected at one end to said swivel and the other end of said cable extending to the exit end of the bore hole.

8. The apparatus of claim 7, and means at said entrance end to apply rotation to said first named pipe and means to transmit rotation from said first named pipe to said hole opener.

9. The apparatus of claim 1, and an in-hole motor positioned in said pipe adjacent to the hole opener, said motor including a stator and a rotor, the rotor connected to said hole opener for rotation of said hole opener and means to connect said stator to said pipe and a swivel positioned between said pipe and said hole opener.

10. The apparatus according to claim 9, said member being a cable connected to said first mentioned swivel and the other end of said cable extending to the end of the bore hole.

11. The apparatus of claim 10, and means at said entrance end to apply rotation to said first named pipe.

12. The apparatus of claim 9, and means at said entrance end to apply rotation to said first named pipe.

13. The apparatus of claim 9, in which said member is a pipe extending through the bore hole to the exit end.

14. The apparatus of claim 13, and means at said entrance end to apply rotation to said first named pipe.

15. An apparatus for enlarging a bore hole extending from an entrance end at a surface location in an inverted arcuate type to a terminal exit location at a remote location, which comprises means at the entrance to enter a pipe to which a bore hole opener assembly is attached by a first swivel at one side of said hole opener and from which a member extends longitudinally in said bore hole and connected to said hole opener by a second swivel, and means positioned at the exit end to apply a pull to said last named member, to apply a pull on said hole opener while said hole opener is rotated.

16. The apparatus of claim 15 and in which said last named member is a pipe, extending through the bore hole to the exit end.

17. The apparatus of claim 16, and means at said entrance end to apply rotation to said first named pipe and means to transmit rotation from said first named pipe to said hole opener.

18. The apparatus of claim 16, and means to circulate drilling fluid through said first named pipe connected to said hole opener, means to circulate fluid through the hole opener to be returned exteriorly of said first named pipe to the entrance end and means to circulate fluid from said hole opener through the pipe in said bore hole connected to said second swivel.

19. The apparatus of claim 18, and means at said entrance end to apply rotation to said first named pipe and means to transmit rotation from said first named pipe to said hole opener.

20. The apparatus according to claim 15, and said last named member being a cable connected at one end to said second swivel and the other end of said cable extending to the exit end of the bore hole.

21. The apparatus of claim 15, and means at said entrance end to apply rotation to said first named pipe and means to transmit rotation from said first named pipe to said hole opener.

22. The apparatus of claim 20, and means at said entrance end to apply rotation to said first named pipe and means to transmit rotation from said first named pipe to said hole opener.

23. The apparatus of claim 15, and an in-hole motor positioned in said pipe adjacent to the hole opener, said motor connected to said hole opener.

24. The apparatus according to claim 23, and said last named member being a cable connected at one end to said swivel and the other end of said cable extending to the exit end of the pilot hole.

25. The apparatus of claim 24, and at said entrance ene to apply rotation to said first named pipe and means to transmit rotation from said first named pipe to said hole opener.

26. The apparatus of claim 23, and means at said entrance end to apply rotation to said first named pipe.

27. The apparatus of claim 23, in which said last named member is a pipe extending through the bore hole to the exit end.

28. The appratus of claim 27, and means at said entrance end to apply rotation to said first named pipe and means to transmit rotation from said first named pipe to said hole opener.

29. A hole opener comprising a hole opener body a central bore in said body, cutting elements adjacent to the end of said body; a swivel body member positioned in said bore, a pipe positioned in said bore, a swivel positioned in said bore between said body and said pipe for rotation with said hole opener body, a pilot nose connected to said body, a swivel connected to said pilot nose.

30. The hole opener of claim 29 and means to connect a tubular member to said second named swivel.

31. The hole opener of claim 29 and means to connect a cable to the said second named swivel.

32. In combination with the hole opener of claim 31, a pipe connected to said central bore at said means for attachment of said pipe to said body at said one end of said body; an in-hole motor in said pipe; said in-hole motor comprising a stator and a rotor; means to connect said stator and said pipe against rotation of said stator relative to said pipe; means to connect said rotor to said body, and a packer positioned in said pipe between said stator and said pipe.

33. The hole opener assembly of claim 32, and means to connect a pipe to said second named swivel.

34. The hole opener combination of claim 32, and means to attach a cable to said second named swivel.

35. The process of drilling a bore hole from one entry location to another exit location which comprises drilling a pilot hole between said locations by advancing a bit at the end of a drill string from said entry location to said exit location, providing thrusting means at said entry location and pulling means at said exit location, introducing a hole opener mounted on a pipe into said pilot hole at said one of said locations, circulating drilling fluid through said pipe and hole opener, and advancing said hole opener by pulling on said hole opener with said pulling means from said exit location and pushing on said pipe and hole opener with said thrusting means for said entry location while rotating said hole opener.

36. The process of claim 35, in which the pilot hole is drilled by advancing a bit at the end of a drill pipe from said entry location to said exit location, connecting said pipe to a cable at said exit location, withdrawing said pipe and said cable through said pilot hole, connecting said cable to one end of said hole opener and connecting drilling pipe to the other end of said hole opener, and pulling on said cable.

37. A process for drilling a bore hole from one entry location to another exit location which comprises drilling a pilot hole between said locations by advancing a bit at the end of a drill pipe from said entry location to said exit location, providing thrusting means at said entry location and pulling means at said exit location, connecting a hole opener to said drill pipe at said entry location at one end of said hole opener and connecting a second pipe to the other end of said hole opener, pulling on said second pipe in said pilot hole with said pulling means to advance said hole opener through said pilot hole, and thrusting on said drill pipe with said thrusting means, and circulating fluid through said pipes and said hole opener and rotating said hole opener relative to said pipe in said pilot hole.

* * * * *